US008434643B2

(12) United States Patent
Harris et al.

(10) Patent No.: US 8,434,643 B2
(45) Date of Patent: May 7, 2013

(54) DUAL CHAMBER DISPENSER

(76) Inventors: Ryan Harris, Sandpoint, ID (US); Marcus Anderson, Newport, WA (US); Les Greer, Jr., Sandpoint, ID (US)

( * ) Notice: Subject to any disclaimer, the term of this patent is extended or adjusted under 35 U.S.C. 154(b) by 441 days.

(21) Appl. No.: 12/759,547

(22) Filed: Apr. 13, 2010

(65) Prior Publication Data

US 2011/0248045 A1 Oct. 13, 2011

(51) Int. Cl.
*B65D 35/22* (2006.01)

(52) U.S. Cl.
USPC ..... 222/94; 222/129; 222/541.9

(58) Field of Classification Search ..... 222/94, 222/129, 541.9; 53/467
See application file for complete search history.

(56) References Cited

U.S. PATENT DOCUMENTS

| | | | | | |
|---|---|---|---|---|---|
| 2,517,604 | A * | 8/1950 | Smith | 215/49 |
| 3,068,154 | A * | 12/1962 | Majors | 435/309.1 |
| 3,614,245 | A * | 10/1971 | Schwartzman | 401/132 |
| 3,964,643 | A * | 6/1976 | Morane et al. | 222/129 |
| 4,093,067 | A * | 6/1978 | Hollander, Jr. | 426/109 |
| 4,364,474 | A * | 12/1982 | Hollander, Jr. | 206/219 |
| 4,514,446 | A * | 4/1985 | Kadono et al. | 53/472 |
| 4,927,012 | A | 5/1990 | Rowe | |
| 5,373,966 | A * | 12/1994 | O'Reilly et al. | 222/94 |
| 5,577,636 | A * | 11/1996 | Fukuoka et al. | 222/94 |
| 5,791,801 | A * | 8/1998 | Miller | 401/132 |
| 6,036,005 | A | 3/2000 | Krause et al. | |
| 8,100,294 | B2 * | 1/2012 | May et al. | 222/129 |
| 2004/0149774 | A1 * | 8/2004 | Strong | 222/94 |
| 2005/0072442 | A1 * | 4/2005 | Licari et al. | 132/112 |
| 2005/0145648 | A1 * | 7/2005 | Poynter | 222/94 |

* cited by examiner

*Primary Examiner* — Paul R Durand
*Assistant Examiner* — Donnell Long
(74) *Attorney, Agent, or Firm* — Lee & Hayes, PLLC

(57) ABSTRACT

A disposable dual chamber dispenser that contains separate products until a time of use. The disposable dual chamber dispenser includes an outer dispenser encapsulating an inner dispenser, where the outer dispenser is compliant and the inner dispenser is substantially less compliant than the outer dispenser and configured to break at a failure zone. The outer dispenser may be formed of a single material that is suitable for a blow-fill-seal process and the inner dispenser may be formed of another single material, different than the single material forming the outer dispenser, that is also suitable for a blow-fill-seal process.

20 Claims, 7 Drawing Sheets

DUAL CHAMBER DISPENSER

BACKGROUND

Containers exist for holding multiple separate products to be subsequently mixed and dispensed at a time of use. Such devices usually consist of a dispenser housing a first product and an additional internal reservoir for holding a second product. For example, the separate products may be a two-part epoxy adhesive or a two-part coating, which need to remain isolated until a time of use. Existing multi-reservoir containers generally have a mechanism of releasing one of the products for mixing with the other product to be dispensed. Such dispensers are used in private households, medical environments, marine environments, and aerospace environments for any number of purposes (i.e., to dispense an adhesive, a coating, or a filler). However, it is often difficult to release the product from the internal reservoir, mix the two products within the dispenser and subsequently dispense the two-part product at the time of use.

Disposable dual chamber dispensers have been developed to dispense a two-part mixture at a time of use. These dispensers are typically built with an internal reservoir having a plug that is dislodged, in an effort to mix two products. However, because these dispensers are configured to be squeezed in order to release the product contained within an internal reservoir, it is difficult to sufficiently squeeze both the dispenser and the internal reservoir to release the product contained in the internal reservoir. Other existing dispensers have an inner glass reservoir that is crushed to release its contents. However, when crushed, shards of the glass reservoir may be dispensed with the product and may harm a user.

SUMMARY

This summary is provided to introduce simplified concepts of disposable dual chamber dispensers that provide for efficiently releasing a product to be mixed with another product to be subsequently dispensed. The dispensers are further described below in the Detailed Description. This summary is not intended to identify essential features of the claimed subject matter, nor is it intended for use in determining the scope of the claimed subject matter.

In one implementation, the dual chamber dispenser comprises an outer dispenser having an outer chamber that encapsulates an inner dispenser. The inner dispenser comprises an inner chamber, which contains a product to be dispensed. The inner chamber has an outlet for dispensing the product from the inner chamber and a cap frangibly coupled to the inner chamber. The frangibly coupled cap seals the outlet of the inner chamber to prevent the product from escaping the inner chamber prior to use. Additionally, the outer chamber encapsulating the inner chamber is configured to be compliant to a predetermined force, which when applied by a user allows the user to break off the inner cap frangibly coupled to the inner chamber to release the product.

In some implementations, the dual chamber dispenser comprises an outer dispenser having an outer chamber that encapsulates both the inner dispenser and another product that is different than the product contained with the inner dispenser. Again, the inner dispenser comprises an inner chamber, which contains a product to be dispensed, an outlet for dispensing the product from the inner chamber, and a cap frangibly coupled to the inner chamber. Similarly, the frangibly coupled cap seals the outlet of the inner chamber to prevent the product from escaping the inner chamber prior to use. Additionally, the outer chamber encapsulating the inner chamber is configured to be compliant to a predetermined force, which when applied by a user allows the user to break off the inner cap frangibly coupled to the inner chamber to release the product.

In some implementations, the dual chamber dispensers described above may have an application face configured to apply the product released from the inner chamber to a body, or apply a two-part product released from the outer dispenser and the inner chamber. The application face may be an attachment to the outer dispenser or the application face may be integral to the outer dispenser. Further, the application face may be made of a sponge material, a foam material, a rubber material, a plastic material, combinations of the foregoing, or the like.

In some implementations, the dual chamber dispensers may be manufactured via a blow-fill-seal process. Other manufacturing techniques are also contemplated, for example, a blow-molding process, an injection molding process or any other manufacturing process suitable for forming the dispenser. Depending on the product to be housed in the outer dispenser, the inner dispenser, and the manufacturing process, the dispensers may comprise a polymer, such as polyethylene, ethyl vinyl alcohol copolymer or any other suitable polymer, mixture, or the like that is suitable for forming the dispensers. For example, the outer dispenser may be formed of low-density polyethylene (LDPE), and the inner dispenser may be formed of polypropylene (PP).

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
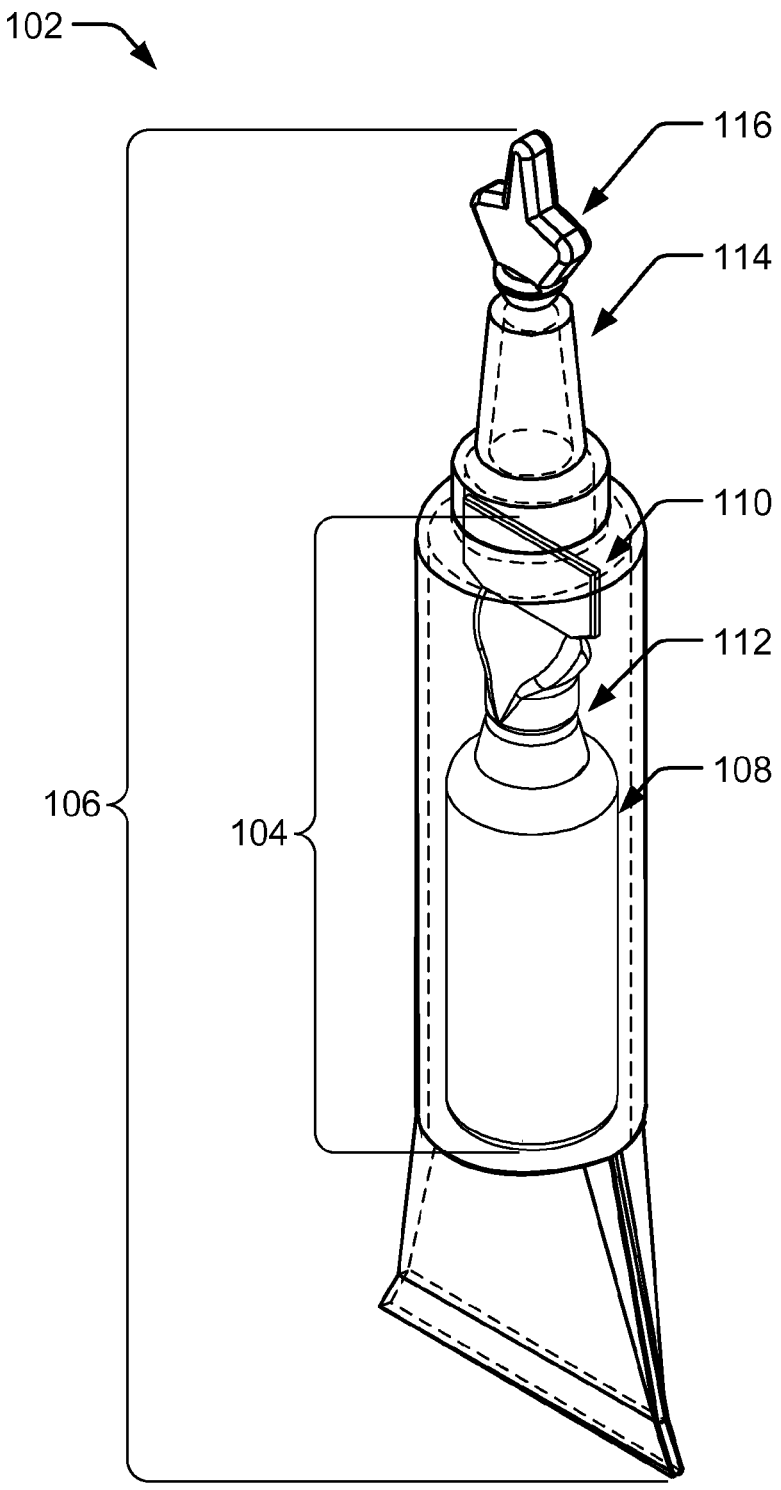
FIG. 1 illustrates an example dual chamber dispenser.

This disclosure is directed to disposable dual chamber dispensers that effectively mix and dispense product contained therein. The dual chamber dispensers comprise an outer dispenser having an outer chamber that encapsulates an inner dispenser. For example, these dual chamber dispensers may be used to contain a two-part epoxy adhesive, medication, coating or other combination of products that should separated until a time of use. In the epoxy example, one chamber (e.g., an inner chamber) may contain a catalyst and another chamber (e.g., an outer chamber) may contain a base. The disposable dual chamber dispenser contains the catalyst and the base separately until a time of use, at which point a user releases the catalyst to be mixed with the base. The user may then apply the mixed two-part epoxy adhesive to a surface.

The outer dispenser comprises a product delivery duct providing an outlet from the outer chamber and a cap removably fixed to the product delivery duct. Further, the outer dispenser may have an application face for applying product to a surface. The application face may be formed of a sponge material, a foam material, a rubber material, or the like (i.e., any suitable material for applying the product contained in the disposable dual chamber dispenser to a body). Alternatively, the outer dispenser may have an applicator tube, spoon, nozzle, spout, or other applicator. Additionally, the outer chamber encapsulating the inner chamber is configured to be compliant to a predetermined moment, which when applied by a user allows the user to substantially deflect (i.e., bend or squeeze) the outer chamber.

The inner dispenser comprises an inner chamber, which contains a product to be dispensed. The inner chamber has an outlet for dispensing the product from the inner chamber and an inner cap frangibly coupled to the inner chamber. The frangibly coupled inner cap seals the outlet of the inner chamber to prevent the product from escaping the inner chamber prior to use. Further, the inner cap may have a tab disposed distal to the inner cap for providing a larger surface area than the cap itself for a user to more easily apply the predetermined moment to the outer chamber. The inner dispenser further comprises a failure zone that is weaker than a wall of the inner chamber and the inner cap, which provides for the inner dispenser to break at the failure zone upon application of the predetermined bending moment. The failure zone may be a score line or a thin section of material disposed between the outlet and the inner cap of the inner chamber. In some embodiments, the inner chamber is substantially rigid and/or brittle, while the outer chamber is flexible and compliant so as to be plastically deformable.

In some implementations, the outer dispenser contains another product, different from the product contained in the inner dispenser. In this implementation, the other product is dispersed about the outside of the inner dispenser for mixing with the product contained in the inner dispenser subsequent to the breaking off of the inner cap. That is, the other product is disposed in the interstitial space between the inner dispenser body and the outer dispenser body.

Illustrative Dual Chamber Dispenser FIG. 1 illustrates an example dual chamber dispenser 102 comprising an inner dispenser 104 encapsulated by an outer dispenser 106. The inner dispenser 104 is illustrated in FIG. 1 as having an inner chamber 108, which is for containing a product (not shown), such as an adhesive, medication, or a coating to be dispensed and subsequently disposed on a surface. In one example, inner chamber 108 may contain a catalyst or a base material of a two-part epoxy to be dispensed, mixed, and subsequently disposed on a surface. In one specific embodiment, outer dispenser 106 may be generally about 3 inches (76.1 millimeters) in length and inner dispenser may be generally about 1.5 inches (38.2 millimeters) in length. However, other sizes of dispensers (larger or smaller) are also possible. FIG. 1 further illustrates an inner cap 110 frangibly coupled to the inner chamber 108. Inner cap 110 seals an outlet of the inner chamber 108 to prevent the product contained within the inner chamber 108 from escaping the inner chamber 108 prior to use. FIG. 1 further illustrates inner dispenser 104 having a failure zone 112. Failure zone 112 is illustrated in FIG. 1 to be generally disposed between the inner chamber 108 and inner cap 110, and is configured to break or snap upon application of a predetermined bending moment (described in more detail below). FIG. 1 further illustrates outer dispenser 106, comprising a product delivery duct 114, which provides an outlet from the outer dispenser, and a cap 116 removably fixed to the product delivery duct 114.

Figure 2A:
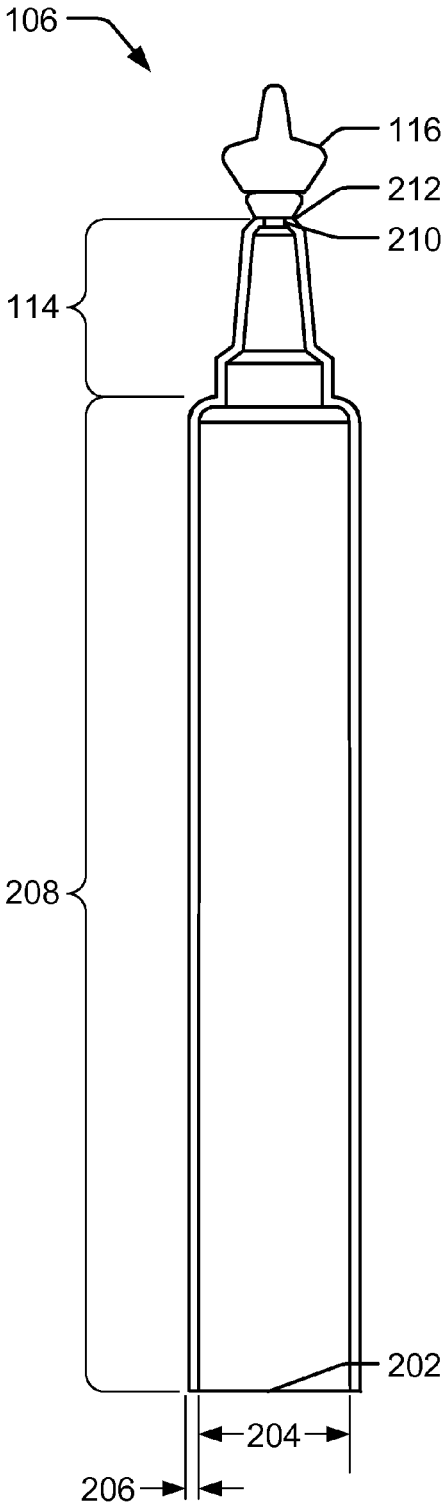
FIG. 2A illustrates a front view of an outer dispenser, of the dual chamber dispenser shown in FIG. 1, with an end open to receive an inner dispenser.

FIG. 2A illustrates a front view of the outer dispenser 106 of the dual chamber dispenser 102 shown in FIG. 1. However, as illustrated in FIG. 2A, outer dispenser 106 is open to receive inner dispenser 104. Specifically, outer dispenser 106 is illustrated as having a substantially circular aperture 202 providing passage for inner dispenser 104 to be inserted into outer dispenser 106 during filling and assembly. In the illustrated example, circular aperture is illustrated as having an inner diameter 204 of about 0.5 inches (12.7 millimeters) and a wall thickness 206 of about 0.02 inches (about 0.5 millimeters) extending the length of the outer dispenser 106 to cap 116. However, other dimensions may also be used. FIG. 2A further illustrates outer dispenser having an outer chamber 208, which is configured to receive and encapsulate inner dispenser 104. Further, outer chamber 208 may also receive and contain another product (not shown), different from the product contained in inner dispenser 104 in the space around the outside of the inner dispenser. As illustrated in FIG. 2A, outer dispenser 106 comprises product delivery duct 114 disposed distal to outer chamber 208. More specifically, product delivery duct 114 has an outlet 210, which when cap 116 is removed allows a product to escape the outer dispenser 106. Here, product delivery duct 114 is illustrated in FIG. 2A as being generally conical in shape, however the product delivery duct 114 may be a variety of shapes. For example, the product delivery duct 114 may be generally polyhedral, tubular in shape, or any other shape suitable for dispensing product from the outer chamber 208. Further, while product delivery duct 114 is illustrated in FIG. 2A and being generally conical in shape, product delivery duct may further include an application face (not shown) for applying a product to a body. For example, an application face may either be integral to, or attach to, product delivery duct and be made of a sponge material, a foam material, a rubber material, or the like. Additionally, an application face may be disc shaped, which may be convex or concave, rectangular shaped, sphere shaped, or the like for applying a product being dispensed from the dual chamber dispenser. FIG. 2A further illustrates cap 116 removably fixed to the product delivery duct 114 to seal the outer chamber 208 prior to use. More specifically, cap 116 is illustrated in FIG. 2A as sealing outlet 210 at an interface 212 disposed between the cap 116 and outlet 210. The interface 212 is designed to be weaker relative to the cap 116 and product delivery duct 114 and configured to break upon application of a predetermined force (e.g., twisting or bending the cap relative to the housing). Subsequent to breaking the interface 212, product is allowed to escape the outer dispenser 106.

Outer dispenser 106 may be formed of an integral unit of polymer, such as polyethylene, ethyl vinyl alcohol copolymer or any other suitable polymer, mixture or the like that is suitable for forming the outer dispenser 106. For example, outer dispenser 106 may be formed of an integral unit of low-density polyethylene (LDPE), which in combination with wall thickness 206 makes outer chamber 208 compliant to a predetermined bending moment (discussed in more detail below).

Figure 2B:
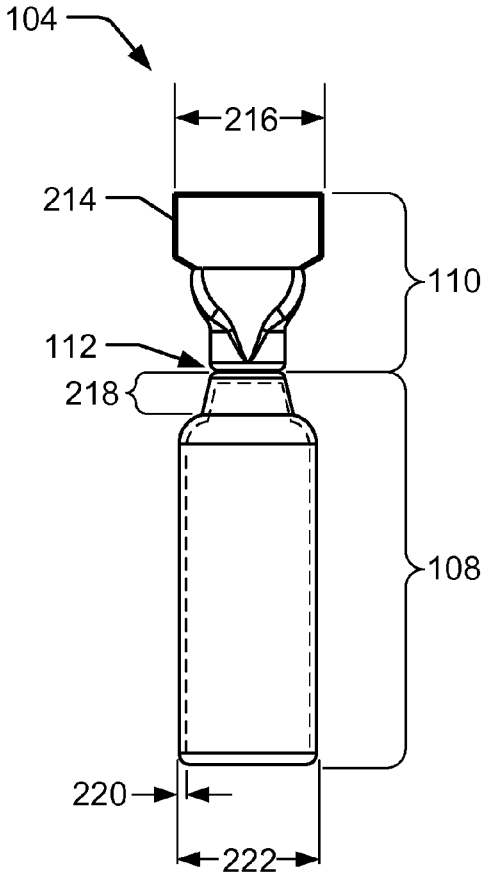
FIG. 2B illustrates a front view of an inner dispenser suitable for insertion into the outer dispenser shown in FIG. 2A.

FIG. 2B illustrates a front view of an inner dispenser 104, of the dual chamber dispenser 102 shown in FIG. 1. As discussed above, and as is illustrated in FIG. 2B, inner dispenser 104 comprises an inner chamber 108 and an inner cap 110 frangibly coupled to the inner chamber 108.

Inner dispenser 106 is substantially rigid/brittle so as to break rather than bend when a user applies a predetermined bending moment to outer dispenser 106. Inner dispenser 106 may also be less permeable to volatile materials than the outer dispenser 106.

FIG. 2B illustrates cap 110 having a tab 214 disposed distal to the cap 110. While FIG. 1B illustrates cap 110 having a generally planar and rectangular-shaped tab 214, other shapes are contemplated. For example, in other embodiments, tab 214 may be disk-shaped, polyhedral-shaped, cone-shaped, or any other shape suitable for breaking inner cap 110 from inner chamber 108 when a user applies a predetermined bending moment to outer dispenser 106. FIG. 2B illustrates tab 214 having a width 216 smaller than outer chamber 208 diameter 204. For example, tab 214 may have a width 216 of about 0.375 inches (9.5 millimeters). As discussed above, and as FIG. 2B further illustrates, failure zone 112 is disposed between the inner cap 110 and inner chamber 108. More specifically, FIG. 2B illustrates failure zone 112 being disposed between an outlet 218 and the inner cap 110 of the inner chamber 108. Failure zone 112 may be a score line or a thin section that is weaker than a wall thickness 220 of inner chamber 108 and the inner cap 110. Additionally, with failure zone 112 being weaker than wall thickness 220 and inner cap 110, inner dispenser 104 is configured to break at the failure zone 112 upon application of the predetermined bending moment. Stated otherwise, inner dispenser 104 is configured to allow a user to break off inner cap 110 frangibly coupled (via failure zone 112) to inner chamber 108 to release a product stored therein.

FIG. 2B further illustrates inner chamber 108 having an external diameter 222 of about 0.375 inches (9.5 millimeters), which is about the same size as tab 214 width 216, and smaller than outer chamber 208 inner diameter 204. Thus, inner dispenser 104 is configured to be encapsulated in the outer chamber 208 of the outer dispenser 106.

As discussed above, inner dispenser 104 may be formed as an integral unit of polymer, such as polyethylene, ethyl vinyl alcohol copolymer or any other suitable polymer, mixture or the like that is suitable for forming the inner dispenser 104. Further, inner dispenser 104 may be made as an integral unit of material different than a material of outer dispenser 106. For example, while outer dispenser 106 may be formed of an integral unit of LDPE, which is compliant to a predetermined bending moment (discussed above), inner dispenser 104 may be formed of an integral unit of polypropylene (PP), which is substantially less compliant to the predetermined bending moment than outer dispenser 106 formed of LDPE.

Figure 3:
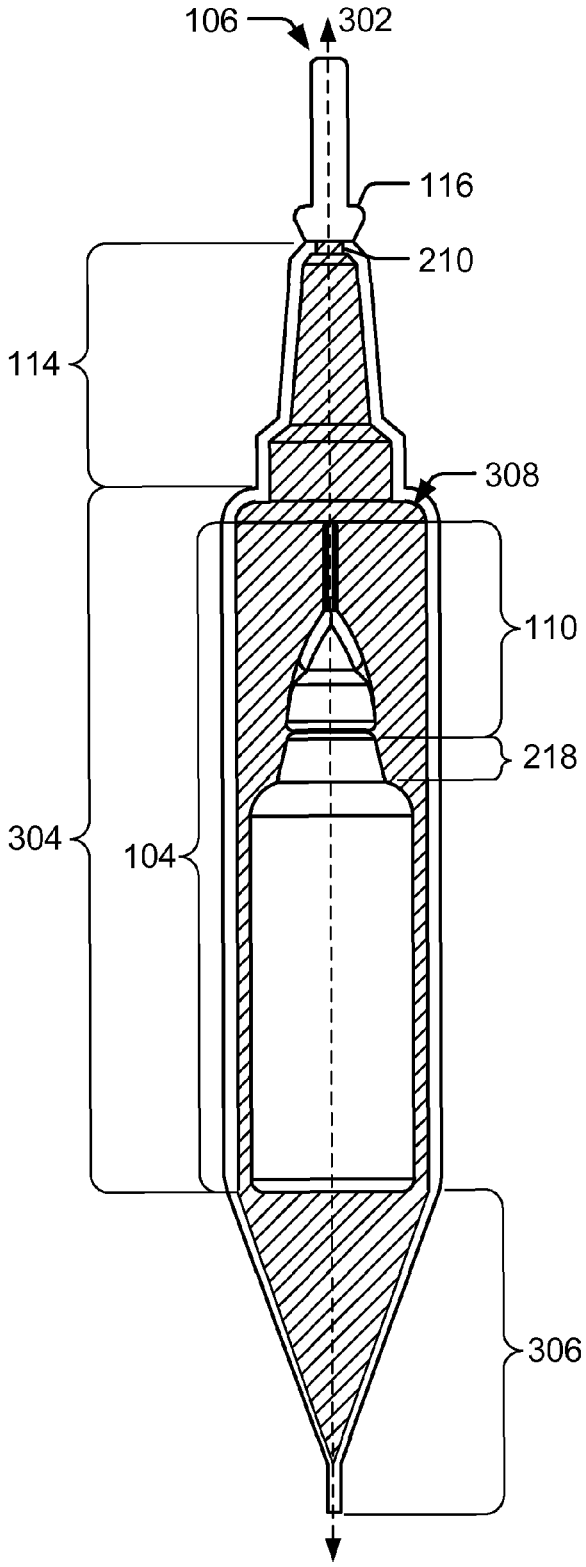
FIG. 3 illustrates a side view of the outer dispenser encapsulating the inner dispenser shown in FIG. 1.

FIG. 3 illustrates a side view of the outer dispenser 106 encapsulating the inner dispenser 104 shown in FIG. 1, respectively. Specifically, FIG. 3 illustrates inner dispenser 104 encapsulated in outer dispenser 106, such that inner dispenser's 104 inner cap 110 and outlet 218 are generally positioned linearly along longitudinal axis 302 and orientated towards outer dispenser's 106 product delivery duct 114 and outlet 210. Further, FIG. 3 illustrates inner dispenser 104 encapsulated in an outer chamber 304. Outer chamber 304 is illustrated in FIG. 3 as comprising a tail portion 306 produced from sealing outer dispenser 106. For example, tail portion 306 may be subsequently produced from a sealing step during the manufacturing process of the dual chamber dispenser 102, such as injection molding, blow molding, or a blow-fill-seal process. While, FIG. 3 illustrates outer chamber 304 encapsulating inner dispenser 104, outer chamber may also encapsulate another product (not shown), different from the product (not sown) contained in inner dispenser 104. In this embodiment, the other product is dispersed about inner dispenser 104 for mixing with the product contained in inner dispenser 104, which is generally contained in a cavity 308 defined between outer dispenser 106 and inner dispenser 104.

FIG. 3 illustrates inner dispenser 104 and outer dispenser 106 as being a tube with a generally circular cross-section. However, inner dispenser 104 and outer dispenser 106 may comprise any other cross-sectional shape suitable for containing separate products until a time of use, and subsequently dispensing a product or dispensing a mixed two-part product. For example, the inner dispenser 104 and outer dispenser 106 may be substantially cone-shaped, polyhedral-shaped, rectangular-shape, or the like.

Figure 4:
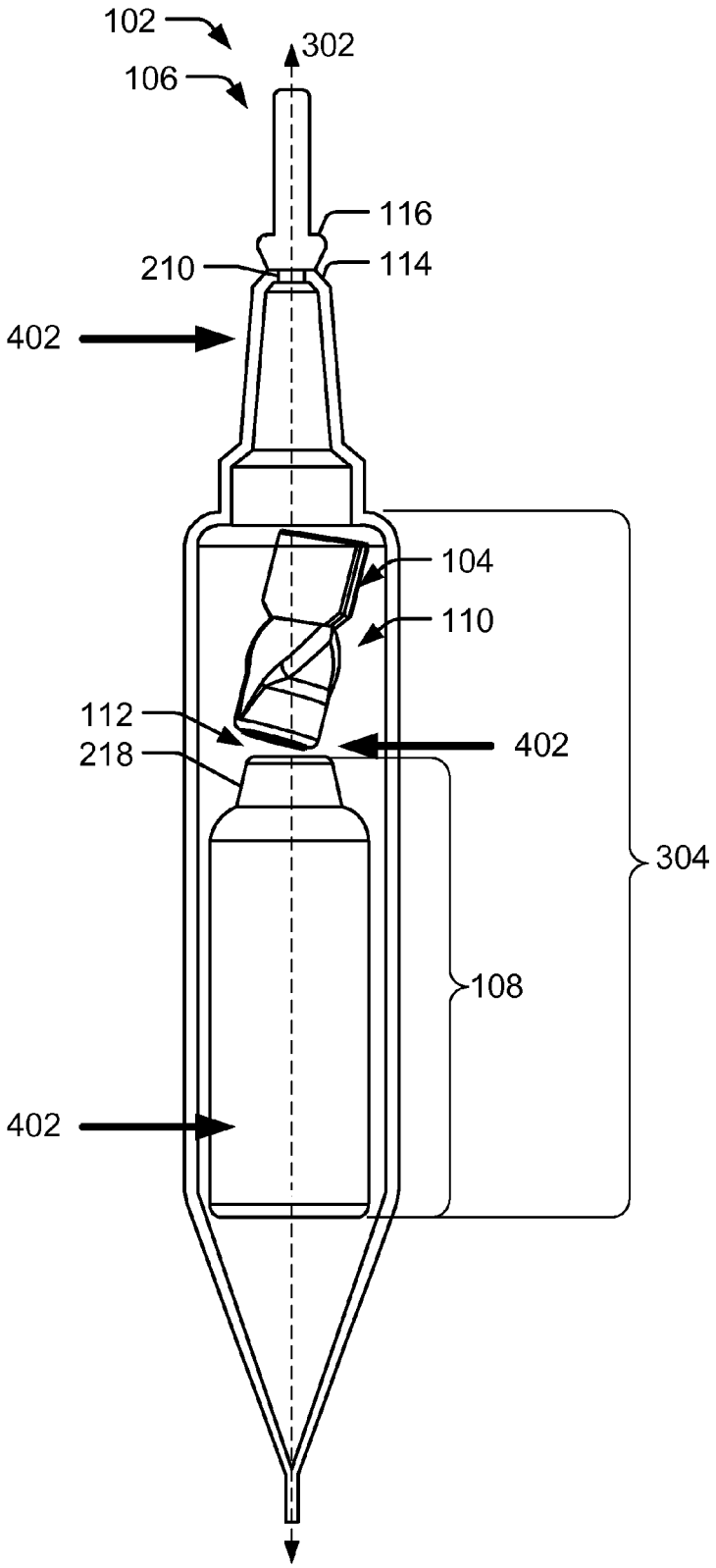
FIG. 4 illustrates a side view of the outer dispenser encapsulating the inner dispenser shown in FIG. 3, with a bending moment applied thereto and an inner cap being broken off of the inner dispenser.

FIG. 4 illustrates a side view of the outer dispenser 106 encapsulating the inner dispenser 104 shown in FIG. 3, and a predefined bending moment 402 generally applied transversely to longitudinal axis 302 of dual chamber dispenser 102. FIG. 4 further illustrates inner cap 110 broken off of the inner chamber 108 as result of a user applying predefined bending moment 402. Specifically, FIG. 4 illustrates outer dispenser 106 having outer chamber 304 that is compliant to predetermined bending moment 402. FIG. 4 further illustrates inner cap 110 being broken or snapped at failure zone 112 and no longer sealing outlet 218 of inner chamber 108. With inner cap 110 broken off of the inner chamber 108, a product is allowed to escape inner chamber 108. As discussed above, once the inner dispenser 104 is opened, both products are subsequently mixed in outer dispenser 106.

Figure 5:
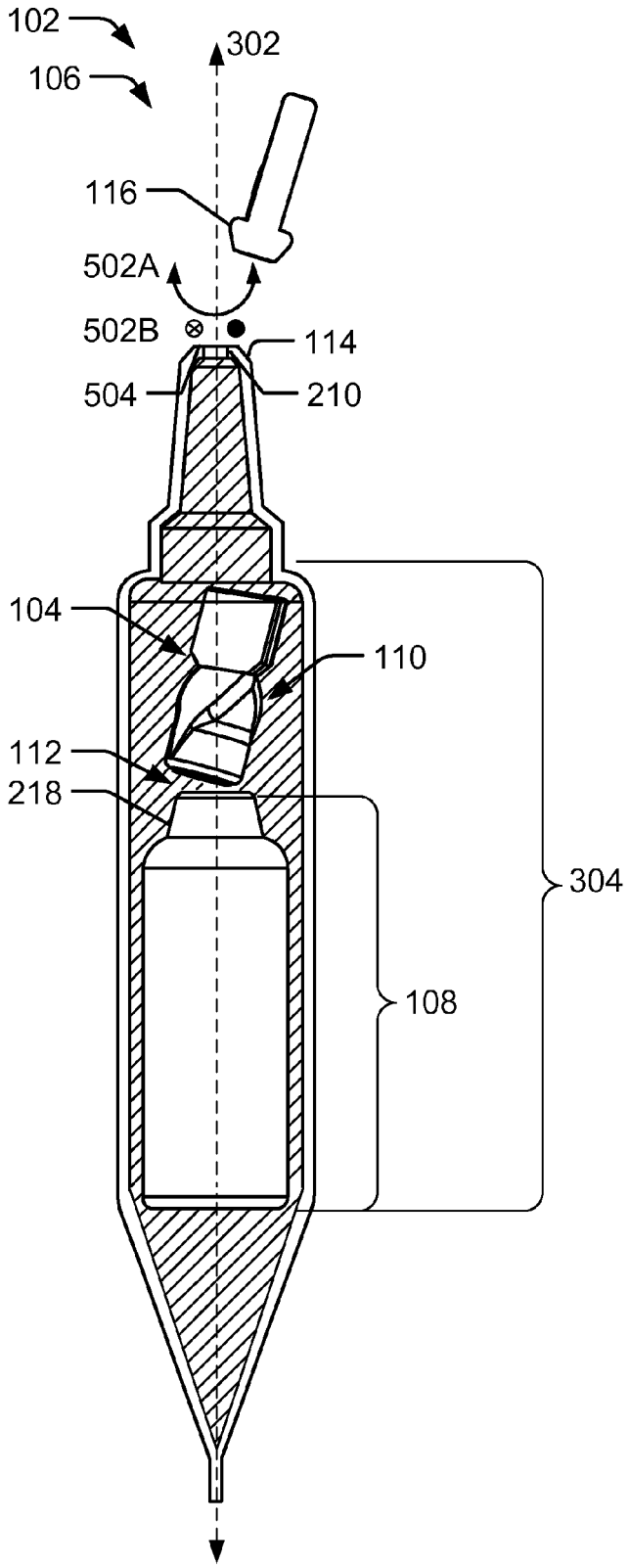
FIG. 5 illustrates a side view of the outer dispenser encapsulating the inner dispenser shown in FIG. 4, with the inner cap broken off of the inner dispenser and with an outer cap removed from the outer dispenser.

FIG. 5 illustrates a side view of the outer dispenser 106 encapsulating the inner dispenser 104 shown in FIG. 4, with the inner cap 110 that is broken off of the inner chamber 108 of inner dispenser 104, and with cap 116 removed from the outer dispenser 106. Specifically, after the inner cap 110 is broken off of inner chamber 108 at failure zone 112 by a user applying predefined bending moment 402, product is released into cavity 308, and is free to mix with the other product contained in the cavity 308. Upon breaking the inner cap 110 and subsequently releasing product contained in inner chamber 108, a user may rotate and/or bend cap 116 about longitudinal axis 302 to remove cap 116 from product delivery duct 114 to dispense the product from the outer chamber 304 at time of use. FIG. 4 illustrates a predetermined rotational force 502A about the longitudinal axis 302 and/or a predetermined transverse force 502B relative to the longitudinal axis 302 may be translated to interface 504. Interface 504 is disposed between cap 116 and product delivery duct 114 and may be configured similarly to failure zone 112. Specifically, interface 504 may be weaker than wall thickness 206 of product delivery duct 114 and cap 116. Further, interface 504 may be a score line or a thin section that is weaker than wall thickness 206 of product delivery duct 114 and cap 116. Additionally, with interface 504 being weaker than wall thickness 206 of product delivery duct 114 and cap 116, outer dispenser 106 is configured to break at the interface 504 upon application of predetermined rotational force 502A about the longitudinal axis 302 and/or a predetermined transverse force 502B relative to the longitudinal axis 302. When the rotating cap 116 produces either predetermined force 502A or 502B the interface 504 will be broken. As illustrated in FIG. 5, subsequent to the breaking of the interface 504, the cap 116 is free of the outer dispenser 106 and the product contained in outer chamber 304 is free to escape and be dispensed by a user.

Example Process for Using a Dual Chamber Dispenser

Figure 6:
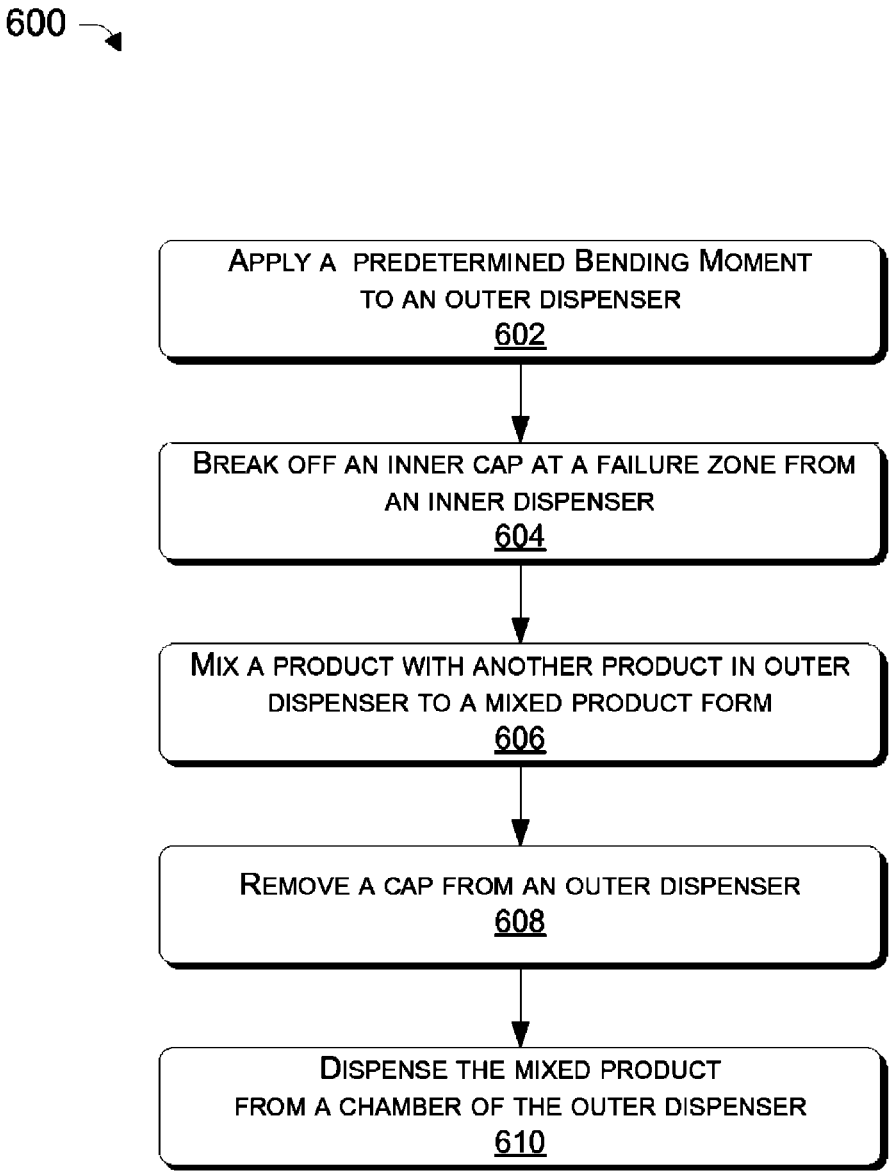
FIG. 6 illustrates an example process of using a dual chamber dispenser.

FIG. 6 illustrates an example process 600 for using a dual chamber dispenser, such as dual chamber dispenser 102. For instance, this process may be performed by a user to use a dual chamber dispenser to dispense an adhesive (e.g., a two-part epoxy), a medicinal product, a coating, a filler or the like. By way of example and not limitation, the process may be performed at a medical facility (e.g., emergency care center, hospital, doctor's office, or the like), a private residence, an aerospace facility, a manufacturing facility (e.g., prior to the distribution of the dual chamber dispenser), or the like. While FIG. 6 illustrates a process for using a disposable dual chamber dispenser configured to contain a product in an inner dispenser encapsulated by an outer dispenser until a time of use, this process may apply to the use of a dispenser configured to contain any amount and/or any type of product.

Process 600 includes an operation 602, which represents a user applying a predetermined bending moment (e.g., predetermined bending moment 402) to an outer chamber (e.g., outer chamber 304) encapsulating an inner dispenser (e.g., inner dispenser 104) configured to be compliant to the applied predetermined bending moment, as discussed above with reference to FIG. 4. For example, the predetermined bending moment may be applied to an outer chamber of outer dispenser (e.g., outer dispenser 106) by a user generally gripping an upper portion (e.g., product delivery duct 114) and a lower portion (e.g., tail 306) and bending or deforming the outer dispenser. Further, the predetermined bending moment may be applied to an outer chamber of outer dispenser by a user generally gripping the top and bottom of the outer chamber and subsequently bending or deforming the outer dispenser. Further, in some embodiments, a user may also squeeze the outer chamber in such a manner as to break the cap off of the inner dispenser. Next, process 600 proceeds to operation 604, which represents breaking or snapping an inner cap (e.g., inner cap 110) at a failure zone (e.g., failure zone 112) as a result of the user applying the predetermined bending moment to the outer dispenser. Subsequent to breaking the inner dispenser at the failure zone, the inner cap is free of the inner dispenser and the product contained in an inner chamber (e.g., inner chamber 108) is free to escape the inner chamber. Operation 604 is followed by operation 606, which represents a user mixing the product previously contained in the inner chamber of the inner dispenser with another product, different than the product previously contained in the inner chamber. For example, operation 606 may represent a user mixing a two-part epoxy, where one part (e.g., catalyst material) was previously contained in the inner chamber and the second part (e.g., base material) is contained in the outer chamber of the outer dispenser and dispersed about the inner dispenser. Alternatively, following operation 604, at operation 606, the product previously contained in the inner chamber of the inner dispenser is not mixed with another product (i.e., the outer chamber of the outer dispenser is void of another product). In either embodiment (i.e., mixing the product with another product or not mixing the product with another product), as discussed above with respect to FIG. 3, process 600 continues with operation 608, where a user removes a cap (e.g., cap 116) of the outer dispenser encapsulating the inner dispenser. Here, a user may remove the cap by applying a predetermined force (e.g., predetermined force 502A and/or 502B) to the cap, which is translated to an interface (e.g., interface 504) disposed between cap and the product delivery duct (e.g., product delivery duct 114), thereby breaking the interface. Further, while operation 608 represents a user applying a predetermined force to a cap and breaking an interface to remove the cap, a user may instead choose to simply cut off the cap generally at the interface disposed between the cap and the product delivery duct. Subsequent to removing the cap, an outlet (e.g., outlet 210) is exposed on top of the product delivery duct for applying product to a body. Process 600 is complete, where at operation 610 the user dispenses a product from the outer chamber by squeezing, pouring, or otherwise evacuating the product from the outer dispenser. Here, as discussed above with respect to FIG. 3, the product being dispensed may be applied to a body using an application face disposed on the product delivery duct.

Example Process for Manufacturing a Dual Chamber Dispenser

Figure 7:
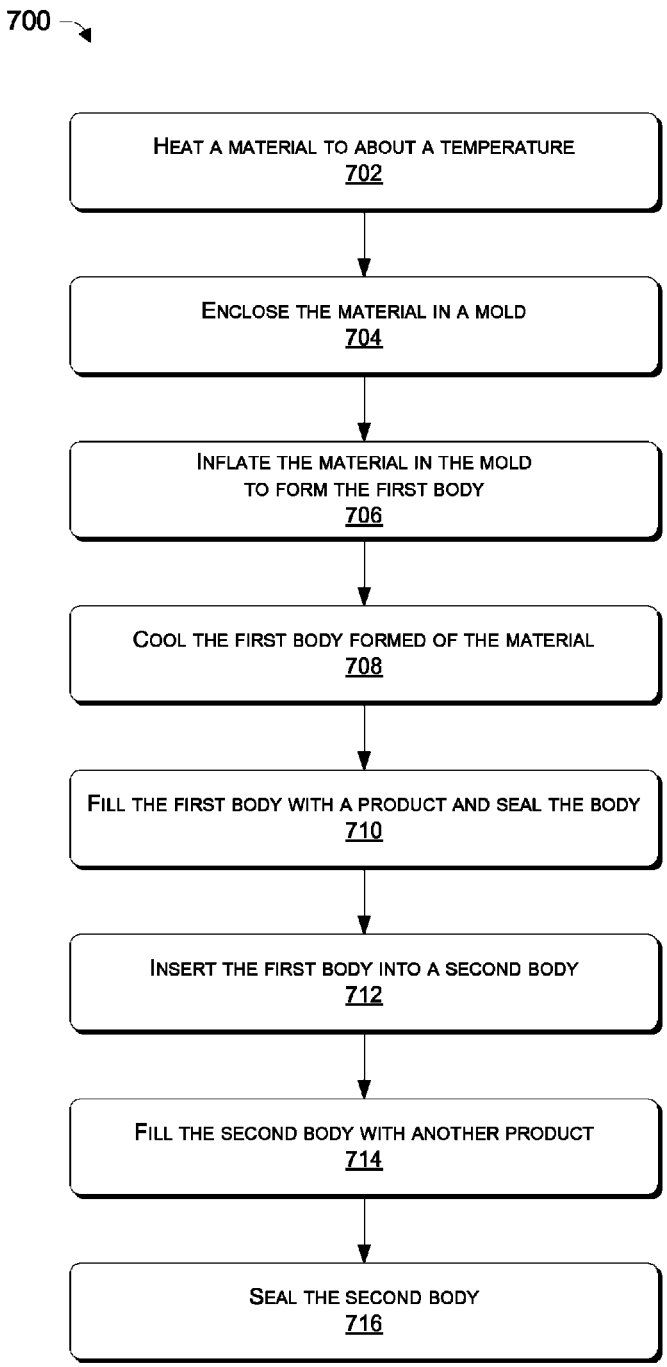
FIG. 7 illustrates an example process of manufacturing a dual chamber dispenser.

FIG. 7 illustrates an example process 700 for manufacturing a dual chamber dispenser (e.g., dual chamber dispenser 102) based at least in part on material characteristics of the particular dual chamber dispenser and product contained therein. For instance, this process may be performed to manufacture a dual chamber dispenser comprising a first unit formed of a single material containing a product that is encapsulated by a second unit formed of another single material for containing another product different from the product contained in the first unit. For example, the dual chamber dispenser and each of the dual chamber dispenser's constituents may be formed of a polymer, such as polyethylene, polypropylene, ethyl vinyl alcohol copolymer or any other suitable polymer, mixture or the like that is suitable for forming the dual chamber dispenser. In some instances, the process may be performed at a manufacturing facility prior to the shipping of the dual chamber dispenser. While FIG. 7 illustrates a process for manufacturing a dual chamber dispenser configured to contain separate products until a time of use when the product is mixed and dispensed, this process may apply to the manufacturing of any type of dispenser. For example, the dual chamber dispenser may be for containing an adhesive to bond materials, a medicinal product to be prescribed, a two-part adhesive to bond materials, or a coating (e.g., two-part coating) to cover a body. Additionally, this process may apply to manufacturing any type of dispenser formed of any other suitable materials capable of being manufactured by injection molding, blow molding, blow-fill-seal processing, or any other suitable manufacturing process. Process 700 includes an operation 702, which represents heating a material (e.g., polyethylene, polypropylene, ethyl vinyl alcohol copolymer) to a temperature of about 130 degrees Celsius. Next, process 700 proceeds to operation 704, which represents enclosing the material in a mold. The mold comprises a shape to form a first body (e.g., inner dispenser 104). The mold includes cavities and protrusions to form an inner chamber (e.g., inner chamber 108) for containing a product to be released from the inner chamber, an outlet (e.g., outlet 218) disposed on the inner chamber for releasing the product from the inner chamber, an inner cap (e.g., inner cap 110) frangibly coupled to the inner chamber for sealing the outlet of the inner chamber to prevent the product from escaping the inner chamber prior to use, and a failure zone (e.g., failure zone 112) that is disposed between the outlet and the inner cap, and which is weaker than a wall thickness (e.g., wall thickness 220) of the inner chamber and the inner cap, such that the inner dispenser is configured to break at the failure zone upon application of a predetermined bending moment (e.g., predetermined bending moment 402). Process 700 continues to operation 706, where a mandrel is used to inflate the material in the mold to form the first body. Operation 706 is followed by operation 708 where the first body formed of the material is cooled to about 50 degrees Celsius. Following operation 708, at operation 710, and subsequent to the cooling of the first body formed of the material, a mandrel is used to fill the first body with a product (e.g., an adhesive, a first part of a two-part adhesive, a coating or other product) and another mandrel is used to seal the first body. Here, the sealing of the first body may form a portion of the inner cap. More specifically, the sealing of the first body may form a tab (e.g., tab 214) disposed distal to the inner cap. After operation 710, process 700 continues with operation 712, where the first body containing a product is inserted into a second body (e.g., outer dispenser 106) generally within an outer chamber (e.g., outer chamber 208), which is configured to receive and encapsulate the inner dispenser, as discussed above with reference to FIG. 2A and FIG. 2B. Following operation 712, at operation 714, and subsequent to the inserting of the first body containing a product, a mandrel is used to fill a cavity (e.g., cavity 308), generally defined between outer dispenser 106 and inner dispenser 104, with another product (e.g., a second part of the two-part adhesive, a coating or other product), different from the product contained in the first body for mixing with the product contained in the first body at a time of use. Alternatively, following operation 712, at operation 714, the cavity is not filled with another product. In either embodiment (i.e., filling the cavity with another product or not filling the cavity with another product), as discussed above with respect to FIG. 3, process 700 is complete where at operation 716 a mandrel is used to seal the second body and encapsulate the inner dispenser. In some instances, operation 716 (i.e., sealing the second body) may form a tail portion (e.g., tail 306) of the outer dispenser.

Conclusion

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative. Also, while one example manufacturing process is described, dispensers according to this disclosure may be made using any other suitable manufacturing process.

What is claimed is:

1. A disposable dual chamber dispenser comprising:
an inner dispenser comprising:
an inner chamber containing a product;
an outlet disposed on the inner chamber for dispensing the product from the inner chamber;
an inner cap frangibly coupled to the inner chamber and sealing the outlet of the inner chamber to prevent the product from escaping the inner chamber prior to use;
an outer dispenser comprising:
an outer chamber encapsulating the inner dispenser and configured to allow a user to break off the inner cap frangibly coupled to the inner chamber to release the product; and
wherein the inner dispenser is free floating within the outer chamber, and the inner chamber has a first rigidity and the outer chamber is less rigid than the inner chamber.

2. The dispenser of claim 1, wherein the inner dispenser comprises:
a tab disposed distal to the inner cap; and
a failure zone that is weaker than a wall thickness of the inner chamber and the inner cap, the inner dispenser being configured to break at the failure zone upon application of a predetermined bending moment.

3. The dispenser of claim 2, wherein the failure zone comprises a score line or a thin section disposed between to the outlet and the inner cap of the inner chamber.

4. The dispenser of claim 1, wherein the outer dispenser further comprises:
a product delivery duct providing an outlet from the outer chamber; and
a cap removably fixed to the product delivery duct to seal the outer chamber prior to use.

5. The dispenser of claim 4, wherein the product delivery duct providing an outlet from the outer chamber comprises an application face for applying the product to a surface.

6. The dispenser of claim 5, wherein the application face for applying the product to a surface comprises a sponge material, a foam material, or a rubber material.

7. The dispenser of claim 1, wherein the inner dispenser is encapsulated in the outer chamber along with another product, different from the product, and dispersed about the inner dispenser for mixing with the product.

8. The dispenser of claim 1, wherein the inner dispenser is made of a material different than a material of the outer dispenser.

9. The dispenser of claim 8, wherein the inner dispenser comprises polypropylene (PP).

10. The dispenser of claim 8, wherein the outer dispenser comprises low-density polyethylene (LDPE).

11. The dispenser of claim 8, wherein the inner dispenser and the outer dispenser are generally tubular shaped.

12. A dual chamber dispenser comprising:
a first chamber containing a product;
an outlet disposed on the first chamber for dispensing the product from the first chamber;
an inner cap frangibly coupled to the first chamber and sealing the outlet of the first chamber to prevent the product from escaping the first chamber prior to use;
the inner cap including an inner tab disposed on a distal end of the inner cap;
a failure zone disposed between the outlet and the inner cap that is weaker than a wall of the first chamber and the inner cap, the inner cap being configured to break at the failure zone upon application of a predetermined bending moment;
a second chamber encapsulating the first chamber compliant to the predetermined bending moment.

13. The dispenser of claim 12, wherein the second chamber further comprises:
a product delivery duct providing an outlet from the second chamber; and
a cap removably fixed to the product delivery duct to seal the outer chamber prior to use.

14. The dispenser of claim 12, wherein the first chamber and the second chamber are injection molded, blow molded, or formed by a blow-fill-seal process.

15. The dispenser of claim 12, wherein the first chamber is made of a material different than a material of the second chamber.

16. The dispenser of claim 15, wherein the first chamber comprises polypropylene (PP) and the second chamber comprises low-density polyethylene (LDPE).

17. A method comprising:
forming a first body containing a product, the first body comprising:
a chamber for containing the first product;
an outlet disposed on the inner chamber;
a cap frangibly coupled to and sealing the outlet of the chamber;
inserting the first body inside a chamber of a second body; and
encapsulating the first body within the second body;
wherein the first body is free floating within the chamber of the second body, and the first body has a first rigidity and the second body is less rigid than the first body.

18. The method of claim 17, further comprising:
subsequent to the inserting of the first body inside the chamber of the second body, filling a cavity between the second body and the first body with another product different from the product.

19. The method of claim 17, wherein the first body comprises polypropylene (PP) and the second body comprises low-density polyethylene (LDPE).

20. The method of claim 17, wherein the forming of the first body and the second body comprises injection molding, blow molding, or a blow-fill-seal process.

* * * * *